United States Patent [19]

Maruta et al.

[11] Patent Number: 4,885,905

[45] Date of Patent: Dec. 12, 1989

[54] RING FOR SPINNING MACHINERY

[75] Inventors: Akira Maruta; Ryouichi Motoyama, both of Amagasaki, Japan

[73] Assignee: Kanai Juyo Kogyo Co., Ltd., Hyogo, Japan

[21] Appl. No.: 258,612

[22] Filed: Oct. 17, 1988

[30] Foreign Application Priority Data

Dec. 28, 1987 [JP] Japan ..... 62-333740

[51] Int. Cl.[4] ..... D01H 7/60

[52] U.S. Cl. ..... 57/119

[58] Field of Search ..... 57/119, 120, 125; 29/527.4

[56] References Cited

U.S. PATENT DOCUMENTS

| | | | |
|---|---|---|---|
| 1,595,858 | 8/1976 | Crompton | 57/119 |
| 1,745,835 | 2/1930 | Merrill | 57/119 |
| 2,194,930 | 3/1940 | Feen | 57/119 |
| 2,798,357 | 7/1957 | Stahli | 57/119 |
| 3,381,464 | 5/1968 | Furst | 57/119 |
| 3,387,447 | 6/1968 | Trammell et al. | 57/119 |
| 3,421,307 | 1/1969 | Lundsford | 57/119 |
| 4,308,715 | 1/1982 | Staehli | 57/119 |
| 4,677,817 | 7/1987 | Kanai | 57/119 |
| 4,698,958 | 10/1987 | Nakano et al. | 57/119 |

*Primary Examiner*—Donald Watkins

*Attorney, Agent, or Firm*—Wenderoth, Lind & Ponack

[57] ABSTRACT

A ring for spinning machinery is made of alloy steel containing Cr 0.9–26% as basic material. The basic material is cut in the desired ring shape, is subjected to gas carburizing, quenching, subzero treatment and tempering and is finally subjected to a grinding. This ring has a surface layer in which carbide occupies 30–90% in the rate of area, with a surface roughness which has an average roughness of less than Ra 0.25 μm at a center line.

11 Claims, 3 Drawing Sheets

RING FOR SPINNING MACHINERY

BACKGROUND OF THE INVENTION

1. Field of the invention

This invention relates to an improvement in a ring for spinning machinery.

2. Description of the prior art

A conventional ring for spinning machinery is manufactured in the following way, namely, low carbon steel is cut in the desired ring shape, is subjected to carburizing as a surface hardening treatment for making the carbon content at the surface 0.8–1.0% and is further subjected to quenching. However, with the increasing severity of producing and spinning conditions in recent years, the conventional ring mentioned above has caused such problems as a lack of abrasion-resistance to the sliding traveller, a shorter service life, etc. Also, rings having a surface subjected to a nitriding treatment and rings with a diffused layer of metal carbide formed at the surface have been used, but rings of these types are low in toughness of surface layer and are easy to peel. Thus, these rings are not satisfactory in terms of service life.

In view of the drawbacks of the conventional rings, the present inventor previously invented a ring for spinning machinery which is made of alloy steel containing Cr 1% and has at least at the surface which makes contact with a traveller a martensite layer containing carbide which is made globular in shape and contains 1.5–3% carbon by carburizing and quenching (Japanese Patent No. 1338741-Patent Application Publication No. 61-3892). However, even the ring for spinning machinery of this type is now unable to cope with high speed continuous spinning operations of more than 13,000 r.p.m. spindle speed as used in recent times.

SUMMARY OF THE INVENTION

After careful studies of the frictional abrasion between the ring and the traveller, the present inventor found that the rate of area of carbide and the surface roughness at the surface of ring greatly affect the frictional abrasion. Thus, the present inventor has improved the ring of his previous invention still further to solve the problems of conventional art.

An object of the present invention is to provide a ring for spinning machinery which can safely be used for high speed spinning of more than 13,000 r.p.m. and has an improved service life. This object has been attained by providing a ring with a surface layer which is high in hardness and has toughness. Such a ring is improved in fatigue-resistance and abrasion-resistance and has less frictional resistance between the ring and the traveller. More particularly, the ring according to the present invention is made of alloy steel containing Cr 0.9–26% in the desired ring shape and has a surface layer in which carbide which has grown, collected and swollen by carburizing and quenching is diffused in insular-like shape and occupies 30–90%, preferably 40–90%, in the rate of area at the depth of at least less than 0.3 mm from the surface of the part where a traveller slides and a roughness of the surface which makes contact with a traveller is less than Ra 0.25 μm in the average roughness at a center line.

The ring for spinning machinery according to the present invention is more effective. But if the carbon content is less than 1.5%, the quantity of carbide is decreased and the effect of abrasion-resistance and fatigue-resistance is reduced. On the contrary, if the carbon content exceeds 5%, carbide is educed in more quantities and the toughness of the ring worsens.

The ring for spinning machinery according to the present invention has a hardness which is Hv 880–1,050 in micro Vickers hardness at its surface layer. It has improved initial fitness, involves less yarn breakage and has a longer service life because it is given a surface treatment, such as a molybdenum disulfide plating, a sulphurizing treatment, a Ni plating or a Ni-P plating.

It is possible for the ring for spinning machinery according to the present invention to diffuse nitrogen 0.01–0.5% in the surface layer by adding ammonia gas to the atmospheric gas during the carburizing treatment. This contributes to decreasing the "traveller burning" and to improving further fitness and service life of the ring.

Regarding alloy steel containing Cr 0.9–26% as a material for rings, Cr steel, Cr-Mo steel, stainless steel, etc. are suitable. If the Cr content is less than 0.9%, carbide is educed in a net-like shape and as a result, fatigue-resistance and abrasion-resistance worsen. On the other hand, if the Cr content exceeds 26%, duration of carburizing must be prolonged and the material cost is increased.

The rate of area occupied by carbide in the surface layer should be 30%–90%, preferably 40%–70%, with 60%–70% as an optimum, at a depth of less than 0.3 mm, preferably less than 0.1 mm, from the surface. If the rate of area is smaller, the effect of abrasion-resistance is less, and if it is larger, toughness worsens, and poor toughness can cause peeling and cracking.

Between the ring and the traveller, there is formed a lubricating layer, such as an oxidized film layer, an organic matter layer generated by crushing of fiber, a Ni-plating layer from Ni-plating of travellers or the like. This lubricating layer, under the spinning condition of less than 13,000 r.p.m. spindle speed, restricts "burning" caused by direct contact between the ring and the traveller. However, under the high speed spinning condition of more than 13,000 r.p.m., frictional heat and stress increase and as a result the lubricating layer has difficulty existing in a stabilized condition, and direct contact between the ring and the traveller takes place. This direct contact accelerates the generation of heat and adhering action, with the result that the service life of rings is shortened considerably.

In the case of the conventional ring for spinning machinery, the rate of area of carbide is 2–3% or less and if the surface roughness is made fine, the area of contact between the ring and the traveller becomes large. This causes adhesion and abrasion, with resultant "traveller burning" and increase in the quantity of abrasion of the traveller. Therefore, in the case of conventional rings, abrasion of the traveller is reduced by making the surface roughness coarse. However, a low rate of area of carbide at the surface layer and roughness at the surface cause abrasion of travellers and an increase in the quantity of abrasion at high speed spinning of more than 13,000 r.p.m.

In the case of the ring for spinning machinery according to the present invention, as carbide which is swollen and diffused in insular-like shape at the surface layer has a high hardness and low adhesion to iron, even if the lubricating layer is broken and direct contact between the ring and the traveller takes place under the high speed spinning condition, adhesion is difficult to take place, "traveller burning" does not take place and good abrasion-resistance is displayed. As the rate of area of carbide at the surface layer is large, there is a fear that hard carbide can cause an increase in abrasion of travellers, but by making the surface roughness fine, abrasion is decreased. Moreover, generation of adhesion and abrasion due to an increase in the area of contact can be restricted by the existence of carbide in large quantities.

BRIEF DESCRIPTION OF THE DRAWINGS

The nature and advantages of the present invention will be understood more clearly from the following description made with reference to the accompanying drawings, in which.

DETAILED DESCRIPTION OF THE INVENTION

A description is made below of an embodiment of the present invention.

The ring for spinning machinery according to the present invention is made in the following way. High carbon chrome bearing steel (SUJ-2) containing Cr 1.5% and C 1% is cut in the desired ring shape, is subjected to a gas carburizing at 880° C. for 15 hours, is subjected to quenching in oil at 850° C., is subjected to a subzero treatment at −50° C., is subjected to tempering at 200° C. for 3 hours and finally is subjected to an abrading treatment to make the surface roughness at the part where a traveller slides less than Ra 0.25 μm, preferably less than 0.2 μm, in the average roughness at a center line. As to the carburizing temperature, the temperature within the range of 850° C.-930° C. is desirable. If it exceeds 930° C., ring material becomes coarse and massive carbide is educed along the grain boundary, with the result that rings are cracked during running of travellers and are easy to abrade. If it is less than 850° C., satisfactory carburizing cannot be carried out.

According to the present invention, by carrying out the subzero treatment, residual austenite generated at quenching is made into martensite so as to increase hardness and improve abrasion-resistance. Instead of the subzero treatment, it is possible to carry out the secondary quenching at 840° C.

Figure 1:
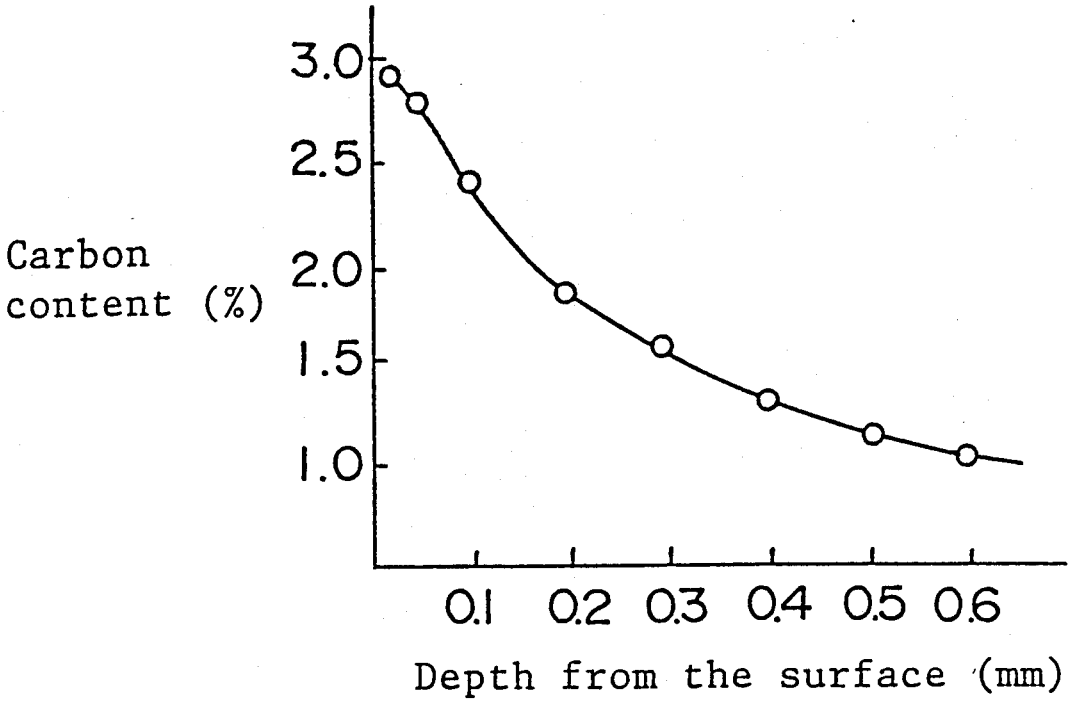
FIG. 1 is a graph of the distribution of carbon content of one embodiment of the ring for spinning machinery according to the present invention.
Figure 2:
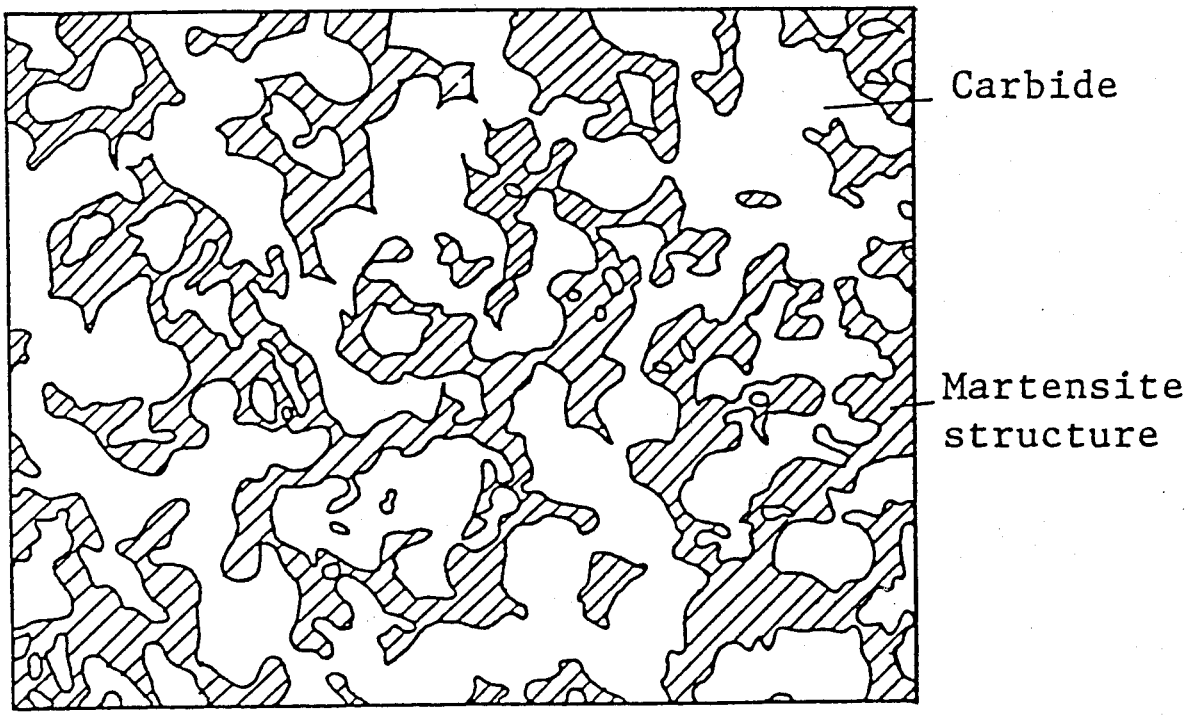
FIG. 2 is a type drawing of a metal structure according to the present invention at a magnification of 2,000.

As shown by FIG. 1, in the case of the ring for spinning machinery according to the present invention carbon content of the surface layer at the depth of 0.02 mm–0.05 mm from the surface is about 3% and decreases gradually with the increase of depth. As shown in FIG. 2 (type drawing of 2,000 magnifications), the surface layer turns into a martensite structure in which grown, collected and swollen carbide occupies about 60–70% in the rate of area at the depth of less than 0.3 mm, at least less than 0.1 mm, from the surface.

Figure 3:
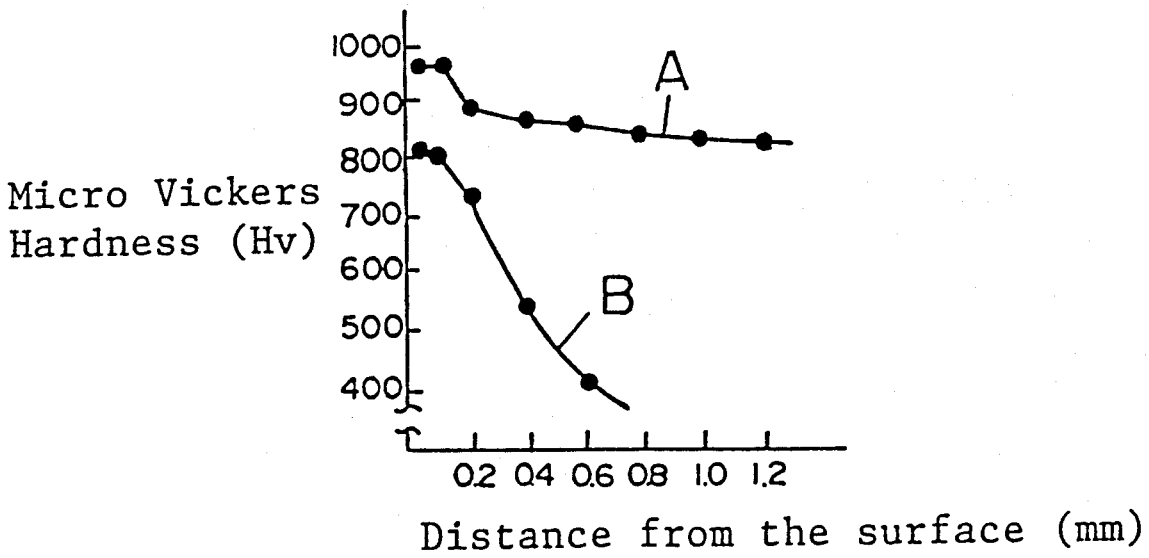
FIG. 3 is a graph of the distribution of hardness in section, showing a comparison between a ring A according to the present invention and a conventional ring B.

As shown in FIG. 3, the ring A for spinning machinery according to the present invention has higher hardness (micro Vickers hardness Hv 880–1,050) at its surface than the conventional ring B. Since its basic material contains 1% carbon, hardness at its inside is also high. Moreover, it has toughness, has high tempering softening-resistance compared with the conventional ring with a carburized layer, is resistant to heat and has high abrasion-resistance.

Figure 4:
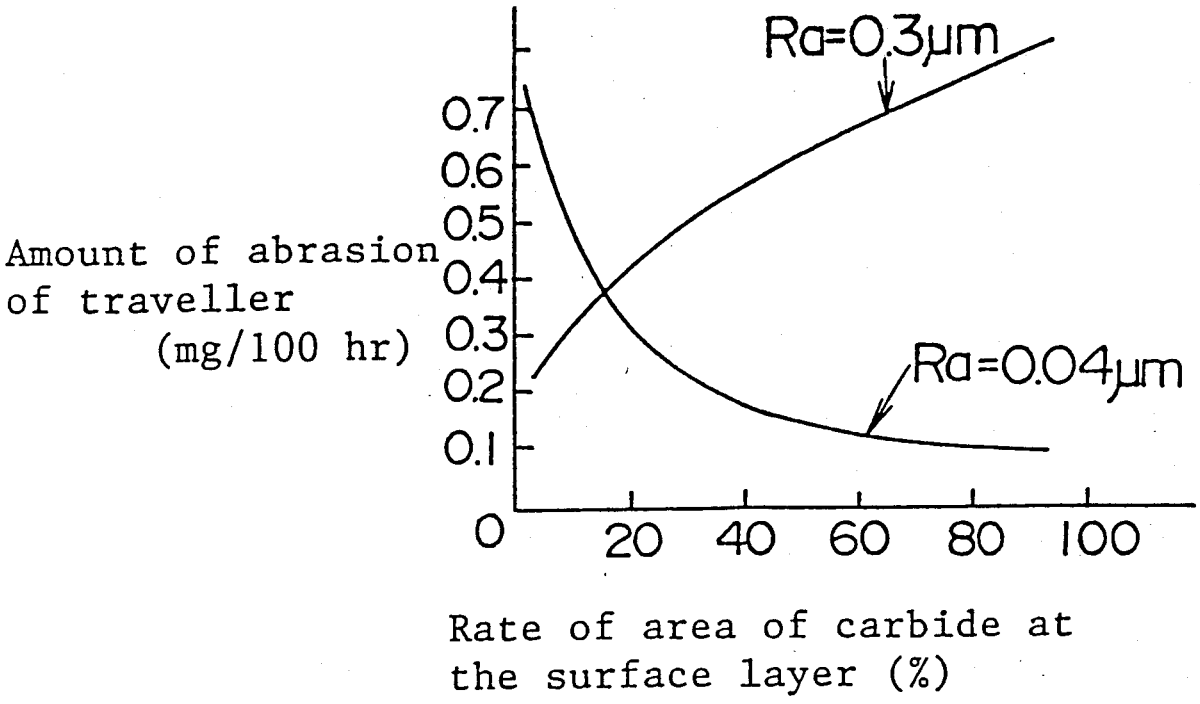
FIG. 4 is a drawing showing the relation between the rate of area of carbide and the amount of abrasion of a traveller at different surface roughnesses.

The ring for spinning machinery according to the present invention has a high rate of area of carbide in the surface layer and therefore there is a fear the abrasion of travellers increases due to the existence of hard carbide in large quantities. This fear could be eliminated by making the surface roughness finer (less than 0.25 μm). FIG. 4 shows the relation between the rate of area of carbide and the amount of abrasion of the traveller in the case where the surface roughness is Ra 0.3 μm and 0.04 μm in the average roughness at a center line. As is obvious from FIG. 4, if the surface roughness is more than 0.25 μm in the average roughness Ra at a center line, a righward rising curve is drawn and with the rise of the rate of area of carbide, the amount of abrasion of traveller increases rapidly. Since the ring for spinning machinery according to the present invention is less than 0.25 μm in the average roughness Ra at a center line and is 30–90% in the rate of area of carbide, it has been possible to reduce the amount of abrasion of traveller to less than 0.4 mg/100 hr. The average roughness at a center line was measued by using a test pin (tip R=2 μm) under the conditions of the cut off value c=0.25 mm, the measuring length L=0.8 mm and the drive speed=0.1 mm/S.

Figure 5:
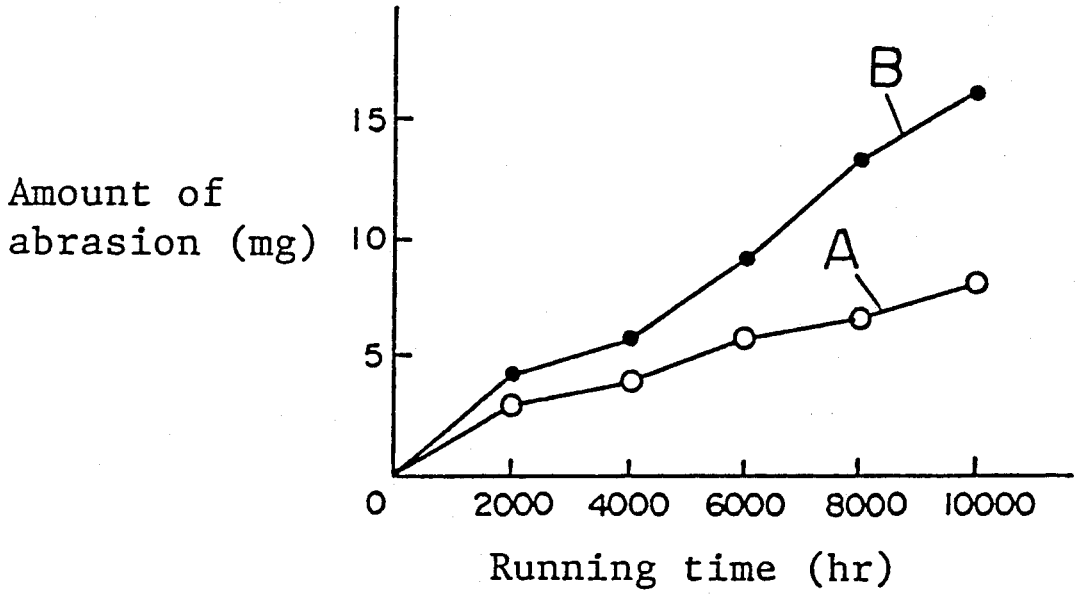
FIG. 5 is a graph of the relation between the amount of abrasion and the running time, showing the comparison between the ring A according to the present invention and the conventional ring B.

FIG. 5 shows the relation between the test time and the amount of abrasion in the case where the ring A for spinning machining according to the present invention and the conventional ring B were tested for abrasion. The test was carried out under the following conditions.

| | |
|---|---|
| Ring: | 3.2F 045 × 57.5 mm |
| Spinning yarn: | Rayon 30's |
| spindle speed: | 13,000 r.p.m. |
| Traveller: | ZSC/hf No. 5 |

From FIG. 5, it can be seen that the ring A for spinning machinery according to the present invention is less in the amount of abrasion and longer in service life than the conventional ring B.

Figure 6:
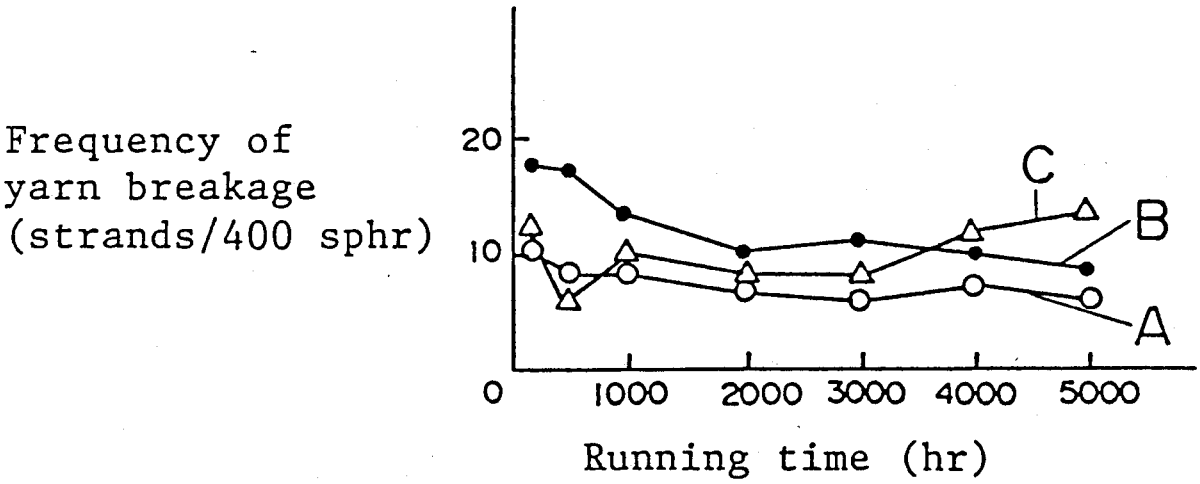
FIG. 6 is a graph of the relation between the frequency of yarn breakage and the running time, showing the comparison among the ring A according to the present invention, the conventional ring B and a ring C presented for purposes of comparison.

FIG. 6 shows the relation between the running time and the frequency of yarn breakage in the case where a spinning test was carried out with the Ring A for spinning machinery according to the present invention, the conventional ring B and the ring C (Ra=0.30 μm) presented for comparison purposes.

The test was carried out under the following conditions.

| | |
|---|---|
| Ring: | 3.2F 038 × 57.5 mm |
| Spinning yarn: | Cotton comber yarn 40's |
| Spindle speed: | 18,500 r.p.m. |

-continued

| Traveller: | YS-2/hf 4/0 |
|---|---|

From FIG. 6, it can be seen that as compared with the conventional ring B and the ring C for comparison purposes, the ring A for spinning machinery according to the present invention has less yarn breakage from the initial stage, is low in the average yarn breakage level and can cope with a higher spindle speed.

In the above embodiment, high carbon chrome bearing steel (SUJ-2) containing Cr 1.5% and C 1% was used but S cr 420 containing Cr 1%, chrome steel of SCM 415 containing Cr 1% and Mo 0.2%, Cr-Mo steel, etc. are applicable. It has been found that the ring for spinning machinery with improved corrosion-resistance can be obtained by applying SUS 405 containing Cr 13%, SUS 403 of ferrite system or stainless steel of martensite system.

It has also been found that by giving the ring for spinning machinery according to the present invention a molybdenum disulphide coating, a sulphurizing treatment, a Ni plating or a Ni-P plating, fitness of ring at initial stage is improved further, frequency of yarn breakage is reduced and service life of ring is prolonged.

Furthermore, by adding ammonia gas $NH_3$ to the atmospheric gas during a carburizing treatment and by diffusing 0.01–0.5% nitrogen in the surface layer, "burning" of rings and travellers is reduced and service life and fitness of rings are improved.

As the ring for spinning machinery according to the present invention is constructed as mentioned above, it has high surface hardness, toughness, improved abrasion-resistance, improved fatigue-resistance, good fitness and less yarn breakage from the initial stage. Moreover, it stands well the high production and high speed running of more than 13,000 r.p.m. spindle speed and its service life is prolonged to a large extent.

What is claimed is:

1. A ring for spinning machinery, said ring made of alloy steel containing 0.9–26% Cr, and said alloy steel of said ring having, at least at a surface for receiving a traveller sliding thereagainst, a surface layer in which swollen and diffused carbide occupies 30–90% of the area of said surface layer, with a surface roughness of less than Ra 0.25 micrometers in average roughness at a center line and a 1.5–5% carbon content.

2. The ring for spinning machinery as set forth in claim 1, wherein said swollen and diffused carbide occupies 40–70% of the area of said surface layer.

3. The ring for spinning machinery as set forth in claim 2 and further comprising, at least at said surface for receiving a traveller sliding thereagainst, a layer formed by a surface treatment comprising a molybdenum disulfide coating, a sulfurized layer, a nickel plating or a Ni-P plating.

4. The ring for spinning machinery as set forth in claim 2, wherein said surface layer contains 0.01–0.5% nitrogen.

5. The ring for spinning machinery as set forth in claim 1, wherein said surface layer has a 2–4% carbon content.

6. The ring for spinning machinery as set forth in claim 1, wherein said surface layer has a hardness of Hv 880–1,050 in micro Vickers.

7. The ring for spinning machinery as set forth in claim 6, and further comprising, at least at said surface for receiving a traveller sliding thereagainst, a surface treatment comprising a molybdenum disulfide coating, a sulfurizing treatment, a nickel plating or a Ni-P plating.

8. The ring for spinning machinery as set forth in claim 6, wherein said surface layer contains 0.01–0.5% nitrogen.

9. The ring for spinning machinery as set forth in claim 1, wherein said alloy steel is a Cr steel, Cr-Mo steel, bearing steel or stainless steel.

10. The ring for spinning machinery as set forth in claim 1, and further comprising, at least at said surface for receiving a traveller sliding thereagainst, a surface treatment comprising a molybdenum disulfide coating, a sulfurizing treatment, a nickel plating or a Ni-P plating.

11. The ring for spinning machinery as set forth in claim 1, wherein said surface layer contains 0.01–0.5% nitrogen.

* * * * *